United States Patent [19]

De Roocker

[11] 4,033,887

[45] July 5, 1977

[54] PHOSPHORIC ACID ESTER BASED FUNCTIONAL FLUIDS

[75] Inventor: Alain J. G. De Roocker, Brussels, Belgium

[73] Assignee: Labofina S.A., Brussels, Belgium

[22] Filed: May 16, 1975

[21] Appl. No.: 578,075

Related U.S. Application Data

[63] Continuation-in-part of Ser. No. 407,539, Oct. 18, 1973, abandoned.

[30] Foreign Application Priority Data

July 13, 1973 Belgium .....802298

[52] U.S. Cl. ..... 252/49.8; 252/78.5

[51] Int. Cl.[2] ..... C10M 1/10

[58] Field of Search ..... 252/78, 49.8 TD

[56] References Cited

UNITED STATES PATENTS

| | | | |
|---|---|---|---|
| 2,596,140 | 5/1952 | Gamrath et al. | 252/49.8 X |
| 2,964,477 | 12/1960 | Pilat et al. | 252/49.8 |
| 3,422,453 | 1/1969 | Frank | 260/982 X |

*Primary Examiner*—Delbert E. Gantz
*Assistant Examiner*—Andrew H. Metz

[57] ABSTRACT

A functional fluid comprising a mixture of (A) an orthophosphoric acid ester of the formula $O=P=(OR)_3$, wherein the groups R, which may be the same or different, are an alkyl radical, an aryl radical or an alkylaryl radical and (B) a transesterification product between a dihydroxy aromatic compound and a phosphorous compound selected from the group consisting of the phosphorous acid ester

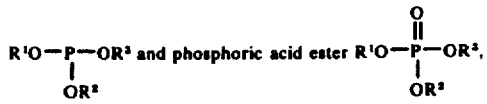

wherein $R^1$, and $R^2$ and $R^3$, which may be the same or different, are alkyl radicals, aryl radicals or alkylaryl radicals. The structural units, and their molecular weight may vary from about 500 to about 2000.

11 Claims, No Drawings

PHOSPHORIC ACID ESTER BASED FUNCTIONAL FLUIDS

RELATED APPLICATIONS

This application is a continuation-in-part of Ser. No. 407,539, filed Oct. 18, 1973, and now abandoned.

BACKGROUND OF THE INVENTION

This invention relates to functional fluids having improved viscosity characteristics.

Functional fluids have many applications. They are particularly useful as lubricants between moving mechanical parts and as force transmission fluids, such as for example, hydraulic fluids. In industrial uses of these functional fluids, the viscosity is of utmost importance, due to the fact that these products are commonly employed under wide ranges of temperature. To obtain satisfactory performance, it is recommended that the functional fluids possess a convenient viscosity temperature relation and a satisfactory flame resistance.

Many compounds and various compositions have already been suggested as functional fluids. Tricresyl phosphates have been used, but their viscosity index is negative. The viscosity index of a fluid is an indication of the viscosity variation of the fluid as a function of the temperature and the most valuable products have a positive index. A negative index for tricresyl phosphates indicates that these products are not useful throughout the temperature ranges normally encountered.

Moreover, the viscosity of many phosphoric acid esters is often too low for the conditions of use which are generally required. To obviate this drawback, phosphoric acid esters having a high molecular weight may be employed. U.S. Pat. No. 2,964,477 discloses such polyesters which may comprise a di-(hydroxy aryl)-alkylidene and a monoester of phosphoric of phosphonic acid. The viscosity characteristics at low temperatures are particularly unfavorable for such high molecular weight materials, however, and this is shown by the relatively low viscosity index obtained, which in some instances is negative. Another known means for overcoming this disadvantage is by incorporating viscosity-index improvers, generally polymers such as polymethacrylates, polyolefines and the like. However, the flame resistance is substantially decreased.

SUMMARY OF THE INVENTION

It is therefore an object of the present invention to provide new functional fluids containing phosphoric acid esters.

Another object of the present invention is to provide functional fluids possessing adequate viscosities at the wide range of temperatures normally encountered in use.

Still another object of the present invention is to provide functional fluids having a low flammability.

A further object of the present invention is to provide functional fluids comprising transesterification products which are of a relatively low molecular weight ranging from about 500 to about 2000, and consisting of from about 1 to about 4 structural units.

In accomplishing the foregoing objects, there has been provided according to the present invention, functional fluids comprising.

A. an orthophosphoric acid ester of formula $O = P(OR)_3$, wherein the R radicals, which may be the same or different, are a $C_6$ aryl radical and preferably phenyl, an alkyl preferably a $C_1$-$C_8$ alkyl, or an alkaryl, preferably a $C_1$-$C_8$ substituted phenyl radical; and B. a low molecular weight transesterification product of from about 1 to about 4 structural units between a dihydroxy aromatic compound and a phosphorous compound selected from the group consisting of phosphorous acid esters of the formula

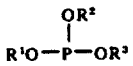

and phosphoric acid esters of the formula

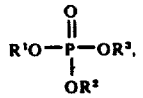

wherein the $R^1$, $R^2$ and $R^3$ radicals, which may be the same or different, are an alkyl, an aryl or an alkylaryl radical, with the preferred substituents being $C_1$-$C_{12}$ alkyl, phenyl and $C_1$-$C_8$ substituted phenyl. The transesterification products have not more than about 4 structural units and a molecular weight of between about 500 and 2000, preferably about 700 to 1500.

DETAILED DESCRIPTION OF PREFERRED EMBODIMENTS

The components A of the composition hereinabove defined are orthophosphoric acid esters of formula $O = P(OR)_3$ wherein the R radicals, which may be the same or different, are an alkyl radical generally comprising from 1 to 8 carbon atoms or a $C_6$ aryl radical, which may have substituents thereto. If a substituent is present, it usually will be an alkyl radical having 1 to 8 carbon atoms. The selection of the compositions of the present invention depends on its properties, more particularly its viscosity characteristics, and also on its price. For instance, tricresyl phosphate, trioctyl phosphate, diphenyl-cresyl-phosphate, phenyldioctyl phosphate and the like may be used. For some applications, phosphoric acid esters containing ethylphenyl radicals are particularly useful; such esters already have a high viscosity index, which is substantially improved by adding the Component B, hereinabove defined.

The Components B of the composition above defined are low molecular weight transesterification products of a dihydroxy aromatic compound and a phosphorous acid ester or a phosphoric acid ester. Hydroquinone, resorcinol, pyrocatechol, 2,2'-bis(4-hydroxyphenyl)-propane (or bisphenol-A) and bis (4-hydroxyphenyl) methane generally are used as dihydroxy aromatic compounds. The dihydroxy aromatic compound is transesterified by a phosphorous acid ester

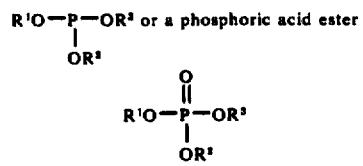

wherein the $R^1$, $R^2$ and $R^3$ radicals, which may be the same or different, are an alkyl, an aryl or an alkylaryl radical. Preferably, the $R^1$, $R^2$ and $R^3$ radicals are alkyl radicals containing from 1 to 12 carbon atoms, a $C_6$ aryl radical or an alkylaryl radical where the alkyl substituent contains from 1 to 8 carbon atoms. According to a preferred embodiment of this invention the phosphorous acid ester or the phosphoric acid ester comprises at least two aryl or alkylaryl radicals. More preferably, these esters are triphenyl phosphate, tricresyl phosphate, trixylyl phosphate, tri(m-ethylphenyl) phosphate or diphenyl-decyl-phosphate.

While the precise composition of the transesterification products is not yet known, they are thought to generally be represented by the following structural formula:

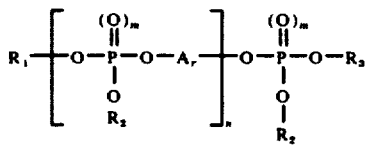

where $n$ is 1, 2, or 3, where $R^1$, $R^2$ and $R^3$, are as above defined, $m$ may be 0 or 1, $n$ may be 1, 2 or 3, and $A_r$ represents the aromatic residue of a hydroxy aromatic compound. The unit contained in the brackets is taken as a structural unit. The molecular weight of these products may be varied according to the molar ratio of the reactants, and where the molar ratio is 1, products with a high molecular weight are prepared. As previously mentioned, such high molecular weight products have unfavorable viscosity characteristics, and while they may be prepared according to the present invention, the preferred transesterification products of the present invention will contain less than 5 structural units and have a molecular weight of less than about 2000. A higher molar proportion of any one of the reactants gives rise to such lower molecular weight products. In order to avoid the production of transesterification products containing residual dihydroxy aromatic compounds, the transesterification reaction is preferably carried out with a molar excess of phosphorus compound. Generally, a molar excess of from about 1.1 moles to about 2 moles of phosphorus compound for every mole of dihydroxy aromatic compound will be utilized, and while a greater excess of phosphorus compound may be used, for example, up to 5 moles of phosphorus compound for every mole of dihydroxy aromatic compound, an excess of higher than 2:1 is of no advantage, either technically or economically. A ratio of about 1.25 moles of phosphorus compound for each mole of dihydroxy aromatic compound has proven particularly favorable.

One or more monohydroxy compounds may be formed as a by-product during the transesterification reaction. For instance, when triphenyl phosphate is used for the transesterification reaction, phenol is formed simultaneously with the transesterification product. In order to shift the reaction equilibrium, it is advantageous to remove the monohydroxy compound as soon as it is formed. This shifting of the equilibrium may be performed by using any known method, for instance by stripping and/or by carrying out the transesterification reaction under vacuum. Basic compounds, such as alkaline metals, alkaline hydroxides, alkaline phenates or alcoholates and the like are catalysts for the transesterification reaction. This reaction is carried out at a temperature which generally is of from about 100° to 200° C., and more preferably between 150° and 180° C. Pressures of from about 2–50 mm Hg are suitable, altough either higher or lower pressures may be employed, as necessary to correlate for distillation of the monohydroxy compounds produced as by products of the transesterification reaction. Reaction times are typically several hours, and generally are between about 3–4 hours.

The viscosity of component A is noticeably improved by adding Component B or transesterification products. The amount of Component B added largely depends on the particular Component A employed, on the particular Component B used and on the desired degree of improvement. However, Component B generally is used in an amount of between 1 and 50% based on the weight of Component A, more particularly in an amount between 1 and 20% by weight.

The functional fluid compositions of the present invention may have their properties further improved by adding thereto an oily material in which these mixtures are soluble. Chlorinated diphenyls are very interesting oils, more particularly for the manufacture of hydraulic fluids having a high flame resistance. The relative proportions of the oily material and of the functional fluid mixture of Components A and B may vary within wide limits, depending upon the particular intended use. For instance, fire resistant hydraulic fluids are prepared by mixing 70 to 95% by weight, of the mixture of components A and B and 30 to 5% by weight of chlorinated biphenyl. Other valuable fluids contain a major proportion of oily material and a minor proportion of the mixture of Components A and B.

Other valuable properties can also be imparted to the functional fluids of the present invention by the optional addition of certain other additives. Typical additives are, for example, foam inhibitors, rust inhibitors and antioxidants. Such additives generally are employed in quantities of from 0.1 to 3% based on the weight of the functional fluids. As an antioxidant, it is preferred to use arylamines and alkylphenols, typically di-tert.butyl-phenol or di-tert.butyl-cresol. These materials usually are employed in quantities from about 0.05 to 1% by weight. As rust inhibitors, higher alkyl malonic or succinic acids and alkaline-earth metal sulfonates may be used, generally in quantity up to 1% by weight and preferably in quantity of 0.01 to 0.5% by weight. Silicones, alpha-chloronaphthalene and other known foam inhibitors may be added to the functional fluids in an amount of from 0.5 to 2% by weight.

The following examples are present to illustrate the present invention:

EXAMPLE 1

A. Preparation of the transesterification product 0.3 mole of triphenyl phosphate and 0.15 moles of bisphenol A were added under agitation to a reactor. 0.5 grams of sodium hydroxide was then added and the mixture heated under a pressure of 10 mm of mercury. The phenol distilled off at about 115°C., and the heating was continued until the temperature rose to 180° C. A viscous, oily product was obtained is substantially quantitative yield. This product had a molecular weight of 1405, consisted of about 3 repeating structural units per molecule and the elemental composition was C, calculated: 68.3% C, found: 67.35%
H, calculated: 5.05% H, found: 5.72%
P, calculated: 8.7% P, found: 8.50%

B. Preparation of functional fluids

Various amounts of the above transesterification product prepared in (A) above were added to tricresyl phosphates as shown in Table 1 below. The viscosities and viscosity indexes which were given in Table I below clearly show that the viscosity index is increased by adding the transesterification product referred to in the Table as "T.P."

TABLE I

| Functional Fluid | Viscosity Engler at 50° C | Viscosity Centistokes at 100° F | Viscosity Centistokes at 210° F | Viscosity Index |
|---|---|---|---|---|
| TCP (a) | 2.44 | 28.25 | 3.96 | −44 |
| TCP + 1% T.P. (b) | 2.67 | 32.04 | 4.48 | 18 |
| TCP + 3% T.P. | 3.04 | 38.46 | 5.03 | 38 |
| TCP + 5% T.P. | 3.47 | 44.46 | 6.18 | 62 |
| TCP + 10% T.P. | 4.84 | 66.87 | 7.56 | 79 |
| TCP + 30% T.P. | 16.70 | 263.9 | 20.19 | 95 |

The improvement which is noticeable when the amount of transesterification product is as low as about 1% is particularly noticeable when this amount is about 5% based on the weight of tricresyl phosphate as may be seen from Table 1 above. Large amounts of transesterification product, such as for instance amounts higher than about 25–30%, do not give rise to a further improvement.

The flame resistance of tricresyl phosphate is not altered when the transesterification product is added. For example, practically pure tricresyl phosphate, on one hand, and tricresyl phosphate containing 5% of transesterification product, on the other hand, have the same spontaneous ignition temperature, i.e., 560°C.

EXAMPLES 2 – 7

The method described in Example 1 was repeated for the manufacture of various transesterification products. Each of these transesterification products was added to tricresyl phosphate in an amount of 5% based on the weight of said phosphate. The particular transesterification product and the properties resulting from their use are summarized in Table II below.

TABLE II

| | Transesterification Product (added to TCP) | Engler at 50° C | Viscosity of the Mixture Centistokes at 100° F | Viscosity of the Mixture Centistokes at 210° F | Viscosity Index | Molecular Weight | Structural Units |
|---|---|---|---|---|---|---|---|
| 2 | Bisphenol A + tricresyl phosphate | 3.47 | 44.46 | 6.18 | 62 | 1694 | 3 |
| 3 | Bisphenol A + tri(m-ethylphenyl) phosphate | 3.16 | 40.30 | 5.31 | 55 | 1690 | 3 – 4 |
| 4 | Bisphenol A + triphenyl phosphite | 2.99 | 38.09 | 4.75 | 0 | 625 | 1 |
| 5 | Bisphenol A + tri(nonylphenyl) phosphite | 2.89 | 35.66 | 4.56 | −9 | 686 | <1 |
| 6 | Bisphenol A + diphenyldecyl-phosphite | 2.69 | 32.74 | 4.43 | 0 | 1039 | ~1 |
| 7 | Hydroquinone + tricresyl phosphate | 2.60 | 31.30 | 4.31 | −4 | 701 | ~1 |

EXAMPLE 8

The transesterification product (T.P.) obtained from bisphenol-A and triphenyl phosphate was added to various aryl phosphates, in an amount corresponding to 5% of the weight of said phosphates. The particular aryl phosphates and the viscosity index of the resulting functional fluids are summarized in the following Table III.

TABLE III

| Functional Fluid | Viscosity Index |
|---|---|
| Tri(m-ethylphenyl) phosphate | 108 |
| Tri(m-ethylphenyl) phosphate +5% T.P. | 135–136 |
| Diphenyl-m-ethylphenyl phosphate | 75 |
| Diphenyl-m-ethylphenyl phosphate +5% T.P. | 114–115 |
| Diphenyl-cresyl-phosphate | 30 |
| Diphenyl-cresyl-phosphate +5% T.P. | 86–87 |
| Phenyl-dioctyl-phosphate | 67 |
| Phenyl-dioctyl-phosphate +5% T.P. | 91 |

EXAMPLE 9

Functional fluids were prepared by adding various transesterification products (T.P.) to diphenyl-cresyl-phosphate, the amount of T.P corresponding to 5% of the weight of said phosphate. The particular T.P. added and the viscosity index of each mixture is given in Table IV below. The viscosity index of diphenyl-cresyl-phosphate is 30.

TABLE IV

| Transesterification Product (added to diphenyl-cresyl-phosphate) | Viscosity Index of Mixture |
|---|---|
| Bis(4-hydroxyphenyl)methane + tricresyl phosphate | 100 |
| Hydroquinone + tricresyl phosphate | 40 |
| Resorcinol + tricresyl phosphate | 46 |
| Pyrocatechol + tricresyl phosphate | 52 |

EXAMPLE 10

A composition was prepared by mixing 85% (by weight) of tri(m-ethylphenyl) phosphate, 5% of the transesterification product between bis-phenol-A and tricresyl phosphate and 10% of chlorinated biphenyl (42% of chlorine). To this mixture was added 5% (by weight of the mixture) of di-tert-butyl-paracresol and 0.1% of calcium petroleumsulfonate. The resulting composition was a fire resistant hydraulic fluid.

What is claimed is:

1. A functional fluid comprising a mixture of a major amount of (A) an orthophosphoric acid ester of formula $O = P = (OR)_3$, wherein R is an alkyl radical, an aryl radical or an alkylaryl radical, and a viscosity improving amount of (B) a transesterification product between a dihydroxy aromatic compound selected from the group consisting of hydroquinone, resorcinol, pyrocatechol, 2,2'bis (4-hydroxy-phenyl)propane and bis(4-hydroxyphenyl) methane and a phosphorous compound selected from the group consisting of the phosphorous acid ester

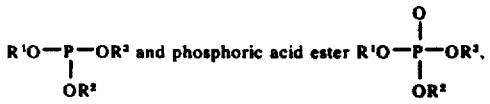

wherein $R^1$, $R^2$ and $R^3$, which may be the same or different, are alkyl radicals, aryl radicals or alkylaryl radicals, wherein said transesterification product contains not more than about 4 structural units and has a molecular weight of between about 500 and 2000.

2. The functional fluid of claim 1, wherein the orthophosphoric acid ester is an ester of formula $O = P = (OR)_3$, wherein each R, which may be the same or different is an alkyl radical having from 1 to 8 carbon atoms, $C_6$ aryl radical or an alkylaryl radical wherein the alkyl substituent has 1 to 8 carbon atoms and the aryl portion has 6 carbon atoms.

3. The functional fluid of claim 1, wherein the transesterification product is the transesterification product of a dihydroxy aromatic compound and a phosphorous compound selected from the group consisting of the phosphorous acid ester

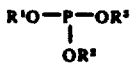

and the phosphoric acid ester

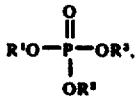

wherein the $R^1$, $R^2$ and $R^3$ radicals, which may be the same or different, are alkyl radicals having 1 to 12 carbon atoms, $C_6$ aryl radicals or alkylaryl radical wherein the alkyl substituent has 1 to 8 carbon atoms and the aryl portion has 6 carbon atoms.

4. The functional fluid of claim 3, wherein said phosphorous compound is a phosphoric acid ester containing at least two of said aryl radicals or alkylaryl radicals.

5. The functional fluid of claim 3, wherein said phosphorous compound is a phosphoric acid ester containing at least two of said aryl radicals or alkylaryl radicals.

6. The functional fluid of claim 1, wherein said transesterification product is the product of a dihydroxy aromatic compound selected from the group consisting of hydroquinone, resorcinol, pyrocatechol, 2,2'bis(4-hydroxyphenyl)propane and bis(4-hydroxyphenyl)methane, and a phosphoric acid ester selected from the group consisting of triphenyl phosphate, tricresyl phosphate, trixylyl phosphate, tri(m-ethylphenyl)phosphate and diphenyl-decyl-phosphate.

7. The functional fluid of claim 1, comprising an orthophosphoric acid ester and said transesterification product in an amount of between 1 and 50% based on the weight of said ester.

8. The functional fluid of claim 7, comprising said transesterification product in an amount of 1 to 20% based on the weight of orthophosphoric acid ester.

9. The functional fluid of claim 1, further comprising 5 to 30% by weight based on the total composition of chlorinated biphenyl in admixture with said mixture of orthophosphoric acid ester and transesterification product, said mixture being soluble in said chlorinated biphenyl.

10. The functional fluid of claim 1, wherein said transesterification product has the formula

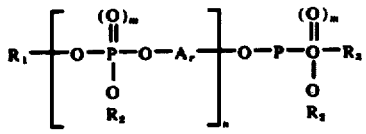

where $n$ is 1, 2, or 3.

11. The functional fluid of claim 1, wherein said transesterification product contains 3 or 4 structural units.

* * * * *